United States Patent [19]

Chaussadas et al.

[11] Patent Number: 4,796,754

[45] Date of Patent: Jan. 10, 1989

[54] OPEN-ENDED MULTIPAK WITH CARRYING STRAP AND METHOD

[75] Inventors: Jean Chaussadas, Deols; Philippe Le Bras, Chateauroux, both of France

[73] Assignee: The Mead Corporation, Dayton, Ohio

[21] Appl. No.: 152,267

[22] Filed: Feb. 4, 1988

[30] Foreign Application Priority Data

Feb. 10, 1987 [GB] United Kingdom ..... 8702976

[51] Int. Cl.[4] ..... B65D 65/00

[52] U.S. Cl. ..... 206/434; 206/427; 206/150; 53/398

[58] Field of Search ..... 206/139, 150, 427, 434, 206/432, 814; 229/52 BC; 53/48, 398

[56] References Cited

U.S. PATENT DOCUMENTS

| | | | |
|---|---|---|---|
| 3,206,020 | 9/1965 | Billingsley et al. | 53/48 |
| 3,650,394 | 3/1972 | De Cazenove | 206/432 |
| 3,930,578 | 1/1976 | Stein | 206/150 |

*Primary Examiner*—David T. Fidei

*Attorney, Agent, or Firm*—Erwin Doerr

[57] ABSTRACT

A package (46) of the wrap-around type has a central row of articles (48) and an auxiliary row of articles (50,52) one on either side of the central row. The articles of the auxiliary rows are disposed in abutting nested relationship with respect to those in the group. A securing strap (S) is provided to hold together the articles of the central row and the strap is held in position closely to embrace the articles in the central row by the abutting articles in the auxiliary rows. An outer open-ended wrapper (54) is provided for maintaining the articles of the auxiliary rows in their abutting nested relationship with respect to the articles in the central row.

14 Claims, 3 Drawing Sheets

OPEN-ENDED MULTIPAK WITH CARRYING STRAP AND METHOD

This invention relates to a multipack preferably of the wrap-around type in which three or more rows of uniform articles are packaged within an open-end wrapper.

It is well known in the multiple packaging art to wrap one or two rows of articles, such as bottles, cans or other generally cylindrical articles in an open-ended wrapper blank. In order to prevent endwise dislodgement of the articles from the wrapper the tops and/or bottoms of the articles cooperate with some form of retaining means provided by the wrapper itself e.g. bottle neck receiving openings, bottle heel or can chine receiving openings and flange receiving slots. Where a larger multipack is desired in which the packaged articles are arranged in more than two rows it normally has been necessary to provide a closed ended carton in order to give adequate article retention.

However, some attempts have been made to provide alternative arrangements e.g. European Pat. No. 0 035 912 where a number of articles are shrink-wrapped in a group whereafter an outer paperboard wrapper is applied to the group. Both this solution and the closed ended carton does involve a greater material stock than an open-ended wrapper.

The present invention seeks to achieve the economy provided by an open-ended wrapper which comprises three or more rows of articles. To this end, one aspect of the invention provides a package comprising a central group of articles and an auxiliary group of articles one on either side of the central group and in which the articles of the auxiliary groups are disposed in abutting nested relationship with regard to those in the central group, characterised in that securing means is provided to hold together articles of the central group, said first securing means being held in position closely to embrace the articles in the central group by the abutting articles in the auxiliary groups and in that second securing means is provided for maintaining the articles of the auxiliary groups in their abutting nested relationship with respect to the articles in said central group. Preferably, the second securing means comprises a wrapper formed from paperboard or a similar foldable sheet material. In arrangements where a paperboard is present, the paperboard wrapper is entirely open-ended. However, the second securing means may comprise a shrink fitted or stretch fitted plastics film sleeve or other film wrapping.

According to another feature of this aspect of the invention, the first securing means may comprise an endless strap encircling said central group of articles Where an endless strap is provided, it may be disposed intermediate the top and bottom ends of the articles.

According to yet another feature of this aspect of the invention, the central group may comprise a single row of articles and each of said auxiliary groups may comprise a single row of articles.

According to a still further feature of this aspect of the invention, the central group of articles comprise two parallel rows of articles in which the articles in one row are in abutting relationship with respect to those in the other row and each of said auxiliary groups may comprise a single row of articles disposed in abutting nested relationship with respect to the adjacent articles in respective ones of the two central rows.

Preferably, the articles are cylindrical and uniform.

Another aspect of the invention provides a method of forming a consolidated group of articles in which outer rows of articles are disposed in abutting nested relationship with respect to a central row of articles, said method including the steps of forming a first group of articles and applying to that group first securing means by which the articles of that group are to be held together, introducing auxiliary groups of articles, one on either side of the central group to form a single consolidated group of articles in which the first group is centrally located and in which the auxiliary groups are disposed in abutting nested relationship with respect to said central group, characterised in that introduction of said auxiliary groups holds said first securing means in position closely to embrace the articles in said central group and in that second securing means is applied to said consolidated group to maintain the articles of the auxiliary groups in their abutting nested relationship with respect to the articles in said central group.

According to a feature of this aspect of the invention, the first group may be conveyed along a central feed path end each of said auxiliary groups may be fed along an auxiliary feed path disposed alongside said central feed path and convergent with respect thereto in the direction of feed.

Embodiments of the invention will now be described, by way of example, with reference to the accompanying drawings, in which.

Figure 1:
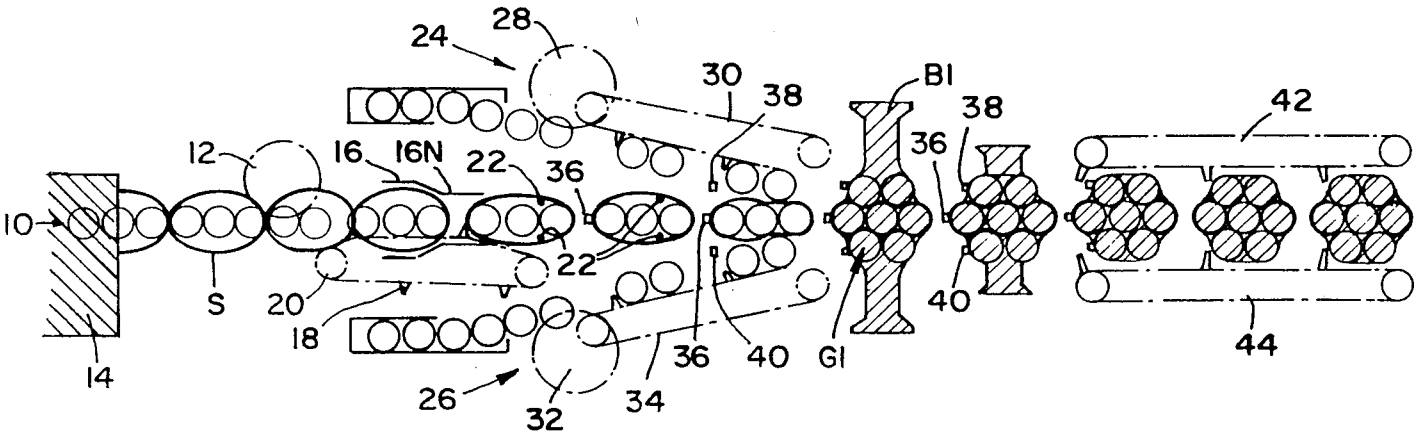
FIG. 1 is a schematic plan view of a packaging operation to form a seven-article multipack according to the invention.

Referring to the drawings in the packaging operation shown in FIG. 1, a central feed line 10 of articles to be packaged (in this case beverage cans) includes an initial grouping operation at which a desired number of cans are grouped from a continuous infeed line by means of a starwheel metering device 12. In some packaging operations according to the invention, the central feed line 10 has two or more parallel rows of articles to be packaged. In this particular embodiment of the invention, the feed line 10 compirses a single row and cans and the starwheel 12 is adapted to create groups of three cans per group which are advanced along the feed path. Whatever the number of rows in the central feed line the packaging operation includes an infeed step in which the initially grouped articles have an endless strap applied to them. The strap is looped around the leading and trailing articles of the group. To this end, a loop forming device 14 is provided at the infeed end of the machine above the central feed line 10. The device 14 forms lengths of a plastics material into loops and heatseals the overlapping ends of each loop by ultrasonic means in order to form an endless strap e.g. strap 'S'. Each strap is despatched along a guide path 16 which converges towards the central feed path by air jets which propell the loops along the guide path. The end of the guide path which is in close proximity to the central feed path 10 is narrowed at section 16N so that each loop is made more ovate and elongate as it is caused to pass through the narrowed guide path section. At this portion of the machine, the article groups are conveyed by chain lugs 18 of a side chain and sprocket set 20. Each of the lugs 18 is timed to engage the trailing i.e. upstream article of its associated group of articles and push that group forwardly along the central feed path 10. During their downward convergent movement with respect to the central feed path each loop is caught by bottom chain lugs 22 which both support the loop and carry it downstream in synchronism with an article group so that the loop is progressively encircled about the article group. The loop is supported temporarily by the chain lugs 22 at approximiately mid-height of the articles. It is not intended at this stage of the packaging operation that the loop should be a tight fit around its associated article group but on the contrary is formed with sufficient girth as to be loose and easily encircled about the group.

Flanking the central feed line 10 at the infeed section of the machine is a pair of similar auxiliary article feed lines 24 and 26 respectively. Feed line 24 includes a starwheel metering device 28 and an outer lug chain assembly 30 which is disposed so as to feed the grouped articles along feed lines 24 convergently with respect to the downstream direction of the central feed line. Auxiliary article feed line 26 is a like arrangement and includes starwheel metering device 32 and outer lug chain assembly 34. In each of the auxiliary feed lines the respective starwheels create groups of a preselected number of articles in this embodiment the starwheels are adapted to create auxiliary groups of two cans per group which are advanced convergently towards the central feed line 10 by the respective outer chain lug assembly. In order to achieve the necessary space in which the auxiliary feed lines are disposed, the side lug chain assembly 18 is substituted by a central bottom lug chain assembly 36 in the central feed path 10 which is responsible for the continued feed of the cans in the central feed line.

The convergent auxiliary feed is timed ultimately to bring the cans in the auxiliary feed lines 24 and 26 into side by side nested relationship with the cans in the central feed line. In this nested arrangement, the cans in each auxiliary row are disposed out of registry with respect to two adjacent cans in the central row. Thus, in this specific embodiment, a pair of cans from each auxiliary feed line is brought into abutting nested relationship on either side of the three cans present in the central feed line, thereby to form a single consolidated group of cans disposed in nested relationship. At or adjacent the downstream end of the outer lug chain assemblies 30, 34 at which the cans in the auxiliary feed lines are about to be brought into parallel movement with respect to the cans in the central feed line, feed of the cans in the auxiliary feed lines is transferred to a respective pair of outer bottom lug chain assemblies 38 and 40, respectively. Thus, the consolidated group G1 is advanced into a wrapping section of the machine by the central and outer bottom lug chain assemblies 36, 38 and 40.

As previously mentioned, it is envisaged that the cenral feed line may comprise more than one row of articles. The articles of these central rows need not necessarily be disposed in nested relationship although the articles of the auxiliary rows are nested with them.

During nesting of the cans from the auxiliary feed paths with those of the central feed path an important aspect of the invention is realised. Movement of the cans in the auxiliary feed lines into abutting nested relationship with the central cans causes the strap 'S' to be deformed inwardly so that it more closely follows the contours of the walls of the cans in the central row and in consequence is made to be a tighter fit holding the central row of cans together as a unit as at position G1. Hence, the girth of the strap 'S' is chosen so that it is relatively loose when initially set about the group of cans in the central feed path but which becomes tightened about the central feed path cans upon introduction of the auxiliary cans into nested relationship therewith.

At position G1 a wrapper blank B1 is applied to the tops of the cans consolidated group and the wrapper and can group are advanced together downstream of the machine. The remaining packaging process is conventional and involves wrapping and securing the wrapper blank about the consolidated group. In order to secure the wrapper about the group, it includes bottom panels which are brought into overlapping relationship and then connected together by any convenient means e.g. interlocked or glued. In order to accomplish this process the feeding of the group is transferred from the central and outer bottom lug chain assemblies 36, 38 and 40 to a pair of parallel side lug chain assemblies 42, 44, respectively. Between the ends of the outer lug chain assemblies 30, 34 and the side lug chain assemblies 42, 44, the cans in the auxiliary feed paths are held from being dislodged from their nested relationship by suitable side guides (not shown) such as fixed side rails or endless moving side belts.

At the completion of the wrapping process, the wrapper blank is secured about the group so that the cans of the auxiliary rows are held nested against those of the central row to form a single unit package. In some arrangements, e.g. where the central feed path produces twin central rows of cans, the strap at each end of the completed package provides a handle portion to facilitate portage of the package.

Figure 2:
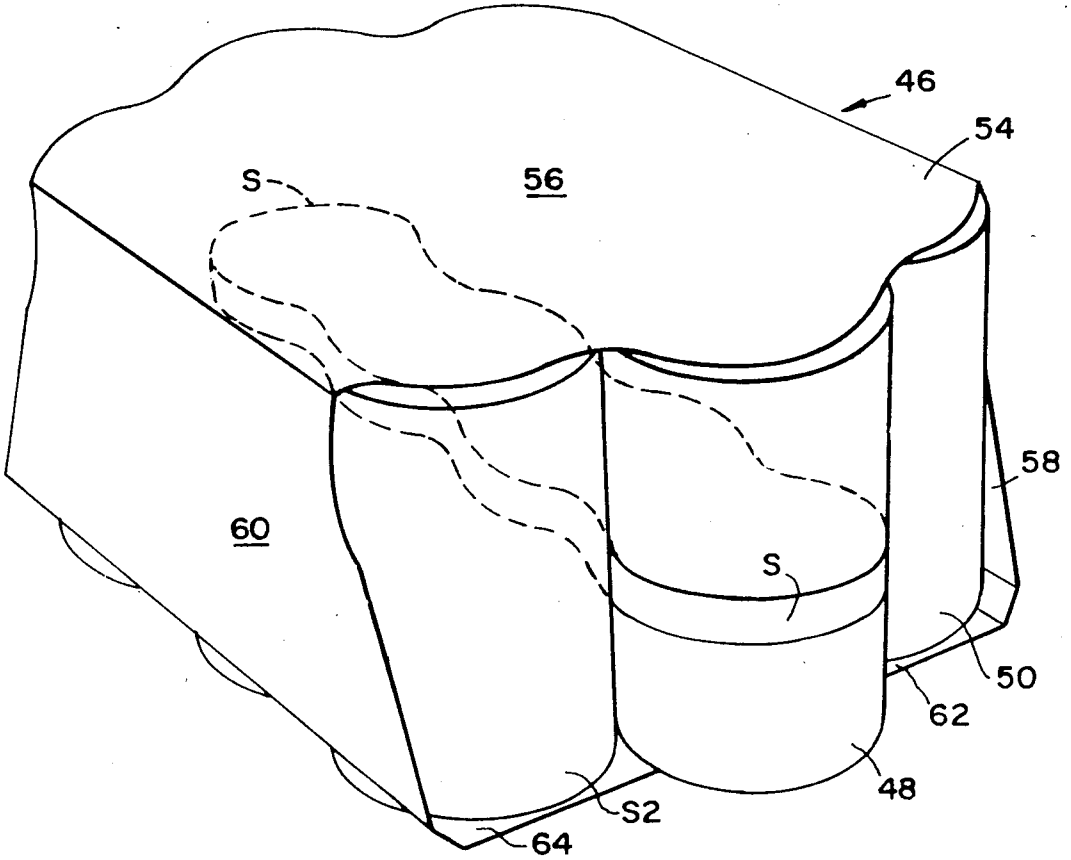
FIG. 2 is a perspective view of one triple row wrap-around type package according to the invention.
Figure 3:
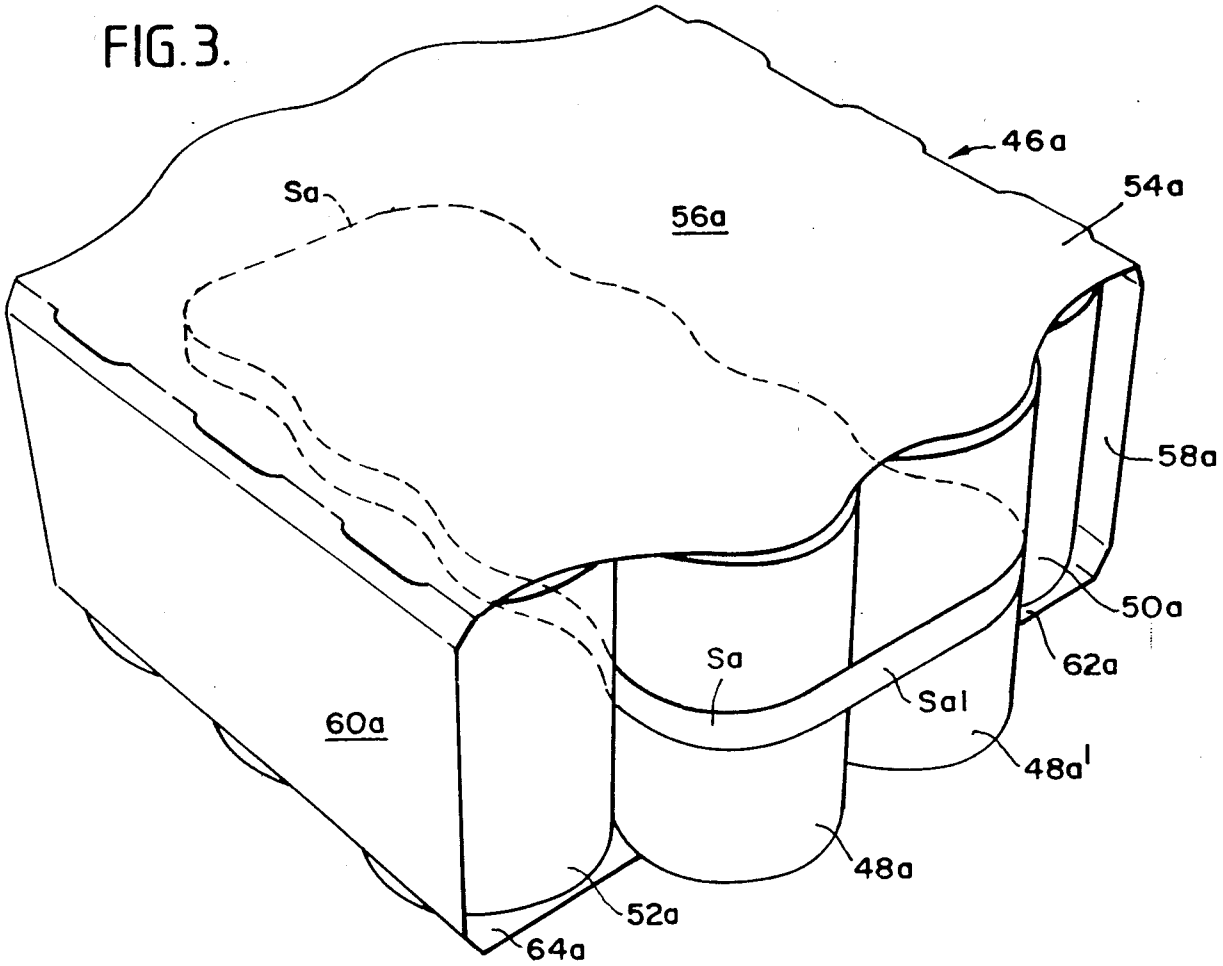
FIG. 3 is a perspective view of another wrap-around type package according to the invention having two central rows of cans.

FIGS. 2 and 3 each show packages according to the invention and like parts are designated like reference numerals with the addition of suffix 'a'. The package 46 in FIG. 2 comprises a central row 48 of four cans and outer auxiliary row 50 and 52 each of three cans. The central row 48 of cans is embraced and held together as a unit by the encircling strap 5. The strap is held in its position intermediate the topsand bases of the cans by the cans in the outer auxiliary rows 50, 52 which are in abutting nested relationship with respect to the cans in the central row thus forming a consolidated group. The group is maintained in that configuration by paperboard wrapper 54 which is entirely open-ended and comprises top panel 56, side wall panels 58 and 60 hinged to opposite side edges of the top wall panel and overlapping base panels 62 and 64 hinged to respective ones of the side wall panels and secured together beneath the bases of the cans.

The package **46*a* in FIG. 2 is of like arrangement except that its central group of articles comprises two rows 48*a* and 48*a'*** each having four cans per row and in which the cans in one row are in abutting registration with the cans of the other row. End portions 'Sal' of the strap encircling both central rows provide a carry handle for the package.

Whereas the above description refers to an outer wrapper of paperboard, it is envisaged that the second (outer) securing means for the article group may comprise a shrink fitted or stretch fitted plastics film sleeve or other plastics film covering.

We claim:

1. A package for a plurality of articles of cylindrical or oval cross section comprising a central group of articles and auxiliary groups of articles one on either side of the central group and in which the articles of the auxiliary groups are disposed in abutting nested relationship with respect to those of the central group, said central and auxiliary groups being held together by first and second securing means, characterised in that said first securing means encircles the articles of the central group and is being held in position closely to embrace the articles of said central group by the abutting nested articles of the auxiliary groups, and in that said second securing means maintains the articles of said auxiliary groups in their abutting nested relationship with respect to the articles in said central group.

2. The package according to claim 1, further characterised in that the articles disposed at the ends of the central group project beyond the end articles of the adjacent auxiliary groups.

3. The package according to claim 1, further characterised in that said second securing means extends in a direction normal to said first securing means.

4. The package according to claim 1, characterised in that said second securing means compirses a wrapper formed from paperboard or similar foldable sheet material.

5. The package according to claim 1, characterised in that said central group comprises an even number of articles and each of said auxiliary groups comprises an uneven number of articles.

6. The package according to claim 4, further characterised in that the paperboard wrapper is open-ended.

7. The package according to claim 1, further characterised in that said first securing means comprises an endless strap.

8. The package according to claim 7, further characterised in that said endless strap is disposed intermediate the top and bottom ends of the articles.

9. The package according to claim 1, further characterised in that said central group comprises a single row of articles and each of said auxiliary groups comprises a single row of articles.

10. The package according to claim 1, further characterised in that said central group of articles comprises two parallel rows of articles in which the articles in one row are in aligned abutting registration with respect to those in the other row and each of said auxiliary groups comprises a single row of articles disposed in abutting nested relationship with respect to adjacent articles in respective ones of the two central rows.

11. The package according to claim 1, further characterised in that said second securing means comprises a plastics film material.

12. A method of forming a package of cylindrical or oval articles comprising a central group of articles and outer groups of articles disposed on both sides of said central group and being held together by first and second securing means, said method comprising the steps of forming a first group of articles and applying thereto a first securing means in the form of a loosely fitting endless band or strap encircling said first group and disposed along the sides of said articles, positioning auxiliary groups of articles one on either side of the central group in abutting nested relationship with respect to the articles in said central group whereby said first securing means is tightened so as to closely embrace the articles in said central group, applying a second securing means to said consolidated groups to maintain the articles of the auxiliary groups in their abutting nested relationship with respect to the articles in said central group.

13. The method according to claim 12, further characterised in that said first group is conveyed along a central feed path and each of said auxiliary groups are fed along an auxiliary feed path disposed alongside said central feed path and convergent with respect thereto in the direction of feed.

14. The method according to claim 13, further characterised in that said second securing means comprises a wrapper which is applied to the consolidated groups of articles in a direction transverse to the direction of feed

* * * * *